US006835886B2

(12) United States Patent
Tamura et al.

(10) Patent No.: US 6,835,886 B2
(45) Date of Patent: Dec. 28, 2004

(54) TONE SYNTHESIS APPARATUS AND METHOD FOR SYNTHESIZING AN ENVELOPE ON THE BASIS OF A SEGMENT TEMPLATE

(75) Inventors: Motoichi Tamura, Hamamatsu (JP); Yasuyuki Umeyama, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 67 days.

(21) Appl. No.: 10/298,032

(22) Filed: Nov. 15, 2002

(65) Prior Publication Data

US 2003/0094090 A1 May 22, 2003

(30) Foreign Application Priority Data

Nov. 19, 2001 (JP) ..... 2001-353006
Nov. 19, 2001 (JP) ..... 2001-353007
Nov. 19, 2001 (JP) ..... 2001-353010

(51) Int. Cl.[7] ..... G10H 7/00; G10H 1/02
(52) U.S. Cl. ..... 84/627
(58) Field of Search ..... 84/626, 627, 663

(56) References Cited

U.S. PATENT DOCUMENTS 5,192,824 A 3/1993 Shibukawa
5,753,842 A 5/1998 Kitamura
5,822,438 A 10/1998 Sekine et al.
6,255,576 B1 * 7/2001 Suzuki et al. ..... 84/604
6,281,420 B1 8/2001 Suzuki et al.
6,284,964 B1 9/2001 Suzuki et al.
6,362,411 B1 3/2002 Suzuki et al.
6,392,135 B1 * 5/2002 Kitayama ..... 84/622
6,403,871 B2 * 6/2002 Shimizu et al. ..... 84/622

FOREIGN PATENT DOCUMENTS

JP 60-60693 4/1985
JP 7-234666 9/1995

* cited by examiner

*Primary Examiner*—Jeffrey W Donels
(74) *Attorney, Agent, or Firm*—Morrison & Foerster LLP

(57) ABSTRACT

Basic envelope is produced for at least one tone on the basis of performance information. In response to a free selection by a user, a segment template including a characteristic variation curve is supplied, and the characteristic variation curve of the segment template is placed on a performance time axis. Then, the placed characteristic variation curve and the basic envelope are combined together to produce a synthesized envelope, and a tone is generated using the produced synthesized envelope. A plurality of segment templates of different lengths are prepared beforehand, which include phrase segment templates corresponding to lengths of phrases, note segment templates corresponding to substantial total lengths of tones, and tone-portion segment templates corresponding to lengths of portions of tones. Two or more segment templates of different lengths selected by the user are combined, as necessary, so as to permit fine envelope control.

29 Claims, 8 Drawing Sheets

NOTE SEGMENT TEMPLATE

| TYPE | | | | | | | | | |
|---|---|---|---|---|---|---|---|---|---|
| | STRAIGHT | 0 | 1 | 2 | 3 | 4 | 5 | 6 | 7 |
| | | COMPLETE FLAT | RATHER CONVEX CHEVRON SHAPE | | | | | | |
| | RISING | 8 | 9 | 10 | 11 | 12 | 13 | 14 | 15 |
| | | FOR PERFORMANCE START | FOR PERFORMANCE START | SLIGHTLY SHALLOWER THAN NO 8 | SLIGHTLY SHALLOWER THAN NO.9 | CONSIDERABLY SHALLOWER THAN NO 8 | CONSIDERABLY SHALLOWER THAN NO.9 | | |
| | FALLING | 16 | 17 | 18 | 19 | 20 | 21 | 22 | 23 |
| | | FOR PERFORMANCE END | FOR PERFORMANCE END | FOR PERFORMANCE END | SHALLOWER THAN NO.16 | SHALLOWER THAN NO 17 | SHALLOWER THAN NO.18 | | |
| | CONVEX CHEVRON SHAPE | 24 | 25 | 26 | 27 | 28 | 29 | 30 | 31 |
| | | FOR PERFORMANCE END | FOR PERFORMANCE END | SLIGHTLY SHALLOWER THAN NO 24 | SLIGHTLY SHALLOWER THAN NO.25 | CONSIDERABLY SHALLOWER THAN NO 24 | CONSIDERABLY SHALLOWER THAN NO.25 | | |
| | CONCAVE CHEVRON SHAPE | 32 | 33 | 34 | 35 | 36 | 37 | 38 | 39 |
| | | DEEP & QUICK | | | SHALLOW & SLOW | SLIGHT CHANGE | | | |
| | LEAP | 40 | 41 | 42 | 43 | 44 | 45 | 46 | 47 |
| | | STRONG & DEEP | STRONG & SHALLOW | WEAK & DEEP | WEAK & SHALLOW | | | | |

FIG. 3A

ENTRANCE-SEGMENT-TEMPLATE DESIGNATING TABLE

| TIME VALUE | | ♩ ≧ | | 𝅗𝅥 ≧ | | 𝅝 ≧ | | 𝅝 < | |
|---|---|---|---|---|---|---|---|---|---|
| RELATIONSHIP TO PRECEDING NOTE | | Finish | Joint | Finish | Joint | Finish | Joint | Finish | Joint |
| INITIAL PERFORMING OPERATION INTENSITY | STRONG | 96 | 100 | 104 | 108 | 112 | 116 | 120 | 124 |
| | MEDIUM | 64 | 68 | 72 | 76 | 80 | 84 | 88 | 92 |
| | WEAK | 32 | 36 | 40 | 44 | 48 | 52 | 56 | 60 |
| | SLUR | 1 | | | | | | | |

FIG. 3B

FINISH-SEGMENT-TEMPLATE DESIGNATING TABLE

| TIME VALUE | | ♩ ≧ | | 𝅗𝅥 ≧ | | 𝅝 ≧ | | 𝅝 < | |
|---|---|---|---|---|---|---|---|---|---|
| RELATIONSHIP TO FOLLOWING NOTE | | Entrance | Joint | Entrance | Joint | Entrance | Joint | Entrance | Joint |
| PERFORMING STYLE | STICKY | 96 | 100 | 104 | 108 | 112 | 116 | 120 | 124 |
| | ORDINARY | 64 | 68 | 72 | 76 | 80 | 84 | 88 | 92 |
| | PLAIN | 32 | 36 | 40 | 44 | 48 | 52 | 56 | 60 |
| | SLUR | 1 | | | | | | | |

FIG. 3C

TONE SYNTHESIS APPARATUS AND METHOD FOR SYNTHESIZING AN ENVELOPE ON THE BASIS OF A SEGMENT TEMPLATE

BACKGROUND OF THE INVENTION

The present invention relates generally to tone generation apparatus and methods for generating musical tones, voices or other desired sounds. More particularly, the present invention relates to an improved tone generation apparatus and method capable of generating tone waveforms, rich in expression, by controlling various envelopes of waveform data in correspondence with styles of rendition. Note that the present invention is applicable extensively to various equipment, apparatus and methods of all fields capable of producing waveforms of musical tones, voices or other desired sounds, such as automatic performance apparatus, computers, electronic game apparatus and other types of multimedia equipment, not to mention ordinary electronic musical instruments. It should also be appreciated that in this specification, the terms "tone waveform" are used to refer to not only a waveform of a musical tone but also a waveform of a voice or other sound.

The so-called "waveform memory readout" method has been well known, in which waveform data of one or more cycles, encoded by a desired encoding technique, such as the PCM (Pulse Code Modulation), DPCM (Differential PCM) or ADPCM (Adaptive Differential PCM), are prestored in a waveform memory so that a suitable tone waveform can be produced by repetitively reading out the stored waveform data from the memory at a rate corresponding to a desired tone pitch. There have been known various types of waveform memory readout techniques. In tone generators employing such a waveform memory readout technique, it has been conventional to not only merely output waveform data, read out from the waveform data memory, as tone waveform signals, but also control the read-out waveform data for each of predetermined tone factors, such as a tone pitch, volume and color (timbre), so as to produce a tone waveform rich in expression. Among examples of waveform control for controlling a waveform in such a tone generator is the one that is based on various envelope generators (EG), such as a pitch envelope generator, amplitude envelope generator and filter envelope generator, contained in the tone generator. The pitch envelope generator controls a pitch envelope of a tone to be generated so that a readout rate of waveform data is varied in accordance with the controlled pitch envelope to thereby produce a tone waveform of a time-varying pitch. The amplitude envelope generator forms or produces a tone volume envelope and imparts the thus-produced tone volume envelope to waveform data read out from the waveform data memory to thereby control the volume from the beginning to end of sounding of the corresponding tone. Further, the filter envelope generator controls tone color controlling filter characteristics so that waveform data, read out from the waveform data memory, are processed with a filter having the controlled characteristics to produce a tone waveform of a time-varying pitch.

As another example of the waveform control for controlling a waveform, there has hitherto been known the "continuous waveform control", by which a user can control a tone pitch, tone volume, tone color or the like to vary continuously by manipulating a predetermined operator (e.g., expression pedal, bend wheel or modulation wheel) or the like at a given time during a music piece performance whenever the user wants to vary intonation in the performance such as expression, pitch bend, modulation depth, modulation speed or the like. Various control values having been set by the continuous control can be stored in a sequencer, and the thus-stored control values can be edited, as necessary, in the sequencer.

Also known is the waveform control based on a style-of-rendition template function that is provided by a sequencer as its unique function. This waveform control, in response to designation of a musical symbol, imparts music piece data with macro pattern data (or style-of-rendition template) prepared beforehand in association with the designated musical symbol, to thereby control a tone pitch, tone volume, tone color or the like. Among musical symbols and signs for which style-of-rendition templates are prepared beforehand are: dynamic marks like crescendo, diminuendo, piano and mezzo forte; cadence marks like fermata; tempo marks like accelerando and ritardando; and performance indications like glissando, portamento, choking, tremolo, staccato and accent. Still another example of the waveform control has been proposed by the assignee of the instant application in Japanese Patent Laid-open Publication No. 60-60693, in accordance with which a plurality of pitch modulating waveforms (e.g., those of attack pitch, vibrato, portamento and the like), each covering an entire sounding period from the rise to fall of a tone, are prestored in memory and only ones of the pitch modulating waveforms, currently selected by turning on selection switches or otherwise, are combined so as to vary the pitch of the tone on the basis of the resultant synthesized pitch modulating waveform.

However, the above-discussed conventional waveform control techniques for producing a tone waveform would present problems in the following respects. Namely, the above-discussed waveform control technique based on various envelope generators, which is designed to normally perform waveform control per tone such as waveform control of the rise or fall portion of the tone, can not appropriately control a gentle variation etc. of a waveform per phrase (e.g., per measure). With the above-discussed continuous waveform control which is performed independently of individual notes to be performed, it is difficult to control a waveform of only a particular performance section, such as an attack portion, of a tone, a waveform of only a particular tone or phrase, etc. Further, the waveform control based on a style-of-rendition template function of a sequencer can not be used to vary expression of each desired performance section and hence lacks flexibility, because all the style-of-rendition templates have a same time length, i.e. because this waveform control technique is not designed to synthesize a variation curve using a plurality of style-of-rendition templates hierarchically organized according to different time lengths. Further, because the style-of-rendition templates are intended for continuous waveform control, when control is to be performed on a voice (tone color waveform) made up of a plurality of elements, it is not possible to impart a unique style of rendition to each of the elements. Furthermore, the above-mentioned waveform control based on a pitch modulating waveform covering an entire sounding period, where each of the pitch modulating waveforms capable of being turned on and off is intended to control a waveform of an entire tone from the rise to fall thereof, can not control a waveform of only an attack portion of a tone, a waveform of a particular phrase, or the like.

Therefore, for most of the known tone generators employing the conventional waveform control, it has been extremely difficult to perform waveform control to permit great many variations per predetermined portion of a tone or to permit desired variations across a plurality of tones.

SUMMARY OF THE INVENTION

In view of the foregoing, it is an object of the present invention to provide an improved tone generation apparatus and method which can generate tones while readily performing waveform control on a portion of one or more tones in addition to tone-by-tone waveform control.

For example, the present invention seeks to provide a tone generation apparatus and method which can readily perform waveform control on a particular performance section of a tone, by synthesizing an envelope appropriately using a template representative of a characteristic variation curve to be imparted to the performance section of the tone and producing a tone waveform in accordance with the thus-synthesized envelope. The present invention also seeks to provide a tone generation apparatus and method which can readily perform fine waveform control on a particular performance section of a phrase or tone by preparing beforehand templates, each representative of a characteristic variation curve to be imparted to a performance section of a phrase or tone, for each of different time lengths, such as those of phrases, notes, attack portions and release portions, synthesizing an envelope by appropriately combining selected ones of the templates of different time lengths and producing a tone waveform in accordance with the thus-synthesized envelope. The present invention also seeks to provide a tone generation apparatus and method which can modify a shape of a characteristic variation curve of each template, selected from among a plurality of templates each representative of a characteristic variation curve to be imparted to a performance section of a phrase or tone, in accordance with a level, time length or the like of the characteristic variation curve, and thereby allows a user to produce a tone waveform while controlling the tone waveform for each desired performance section.

According to an aspect of the present invention, the present invention provides a tone generation apparatus which comprises: a performance information supply section that supplies performance information; a segment template supply section that supplies a segment template including a partial characteristic variation curve and position information; an envelope synthesis section that produces a basic envelope for at least one tone on the basis of the performance information, arranges, on a time axis based on the performance information, the characteristic variation curve of the segment template in accordance with the position information and combines the characteristic variation curve, arranged on the time axis, with the basic envelope, to thereby produce a synthesized envelope for the at least one tone; and a tone generation section that generates a tone using the produced synthesized envelope.

According to the present invention, the partial characteristic variation curve of a desired segment template is combined with a basic envelope of at least one tone produced on the basis of supplied performance information in arrangement corresponding to the position information included in the segment template, so that a synthesized envelope is produced. Thus, by use of the segment template alone, the present invention can readily produce a synthesized envelope that permits fine control of a particular performance section of a tone. As a result, the present invention can easily produce a tone waveform rich in expression and corresponding to a style of rendition, using the synthesized envelope; namely, the user of the inventive tone generation apparatus can readily generate a tone presenting complicated variations, using a desired segment template.

According to another aspect of the present invention, there is provided a tone generation apparatus which comprises: a performance information supply section that supplies performance information; a segment template supply section that is capable of supplying a plurality of segment templates of different lengths, each of the segment templates including a characteristic variation curve; an envelope synthesis section that arranges the characteristic variation curves of two or more segment templates of different lengths, in correspondence with a given performance section based on the performance information, in such a manner that at least parts of the characteristic variation curves of the two or more segment templates overlap with each other, and produces a synthesized envelope for the given performance section by combining the arranged characteristic variation curves; and a tone generation section that generates a tone using the produced synthesized envelope.

According to the present invention, the characteristic variation curves of two or more segment templates of different lengths are arranged in such a manner that at least respective parts of the characteristic variation curves of the two or more segment templates overlap with each other and a synthesized envelope is produced on the basis of the combination of the characteristic variation curves. Thus, when, for example, fine envelope control is to be performed in a given part of a performance section, it suffices to just paste a characteristic variation curve corresponding to a fine envelope of a necessary length. Namely, the present invention can readily perform fine envelope control of a partial performance section by just combining appropriate segment templates of different time lengths.

According to still another aspect of the present invention, there is provided a tone generation apparatus which comprises: a performance information supply section that supplies performance information; a segment template supply section that is capable of supplying segment templates each including a characteristic variation curve, the segment templates including note segment templates corresponding to substantial total lengths of tones and tone-portion segment templates corresponding to lengths of tone portions; an envelope synthesis section that, in correspondence with a given performance section of a tone based on the performance information, selects one note segment template and one or more tone-portion segment templates, places the selected note segment templates in the given performance section of the tone and the selected tone-portion segment templates in a part of the given performance section of the tone, and produces a synthesized envelope for the given performance section by combining respective characteristic variation curves of the placed segment templates; and a tone generation section that generates a tone using the produced synthesized envelope. In this case too, the present invention can readily perform fine envelope control of a part of a partial performance section of a tone.

According to still another aspect of the present invention, there is provided a tone generation apparatus which comprises: a performance information supply section that supplies performance information; a segment template supply section that supplies a segment template representative of a characteristic variation curve; a modification section that arranges the segment template on a time axis based on performance timing specified by the performance information and modifies the characteristic variation curve of the arranged segment template; an envelope synthesis section that produces a basic envelope on the basis of the performance information and combines the characteristic variation curve, modified by the modification section, with the basic envelope, to thereby produce a synthesized envelope; and a tone generation section that generates a tone using the produced synthesized envelope. By modifying the characteristic variation curve, the present invention can perform fine envelope control rich in variations.

The present invention may be constructed and implemented not only as the apparatus invention as discussed above but also as a method invention. Also, the present invention may be arranged and implemented as a software program for execution by a processor such as a computer or DSP, as well as a storage medium storing such a program. Further, the processor used in the present invention may comprise a dedicated processor with dedicated logic built in hardware, not to mention a computer or other general-purpose type processor capable of running a desired software program.

While the embodiments to be described herein represent the preferred form of the present invention, it is to be understood that various modifications will occur to those skilled in the art without departing from the spirit of the invention. The scope of the present invention is therefore to be determined solely by the appended claims.

BRIEF DESCRIPTION OF THE DRAWINGS

For better understanding of the objects and other features of the present invention, its embodiments will be described in greater detail hereinbelow with reference to the accompanying drawings, in which:

FIGS. 3A to 3C are conceptual diagrams illustrating exemplary data construction of segment templates;

DETAILED DESCRIPTION OF THE EMBODIMENTS

Figure 1:
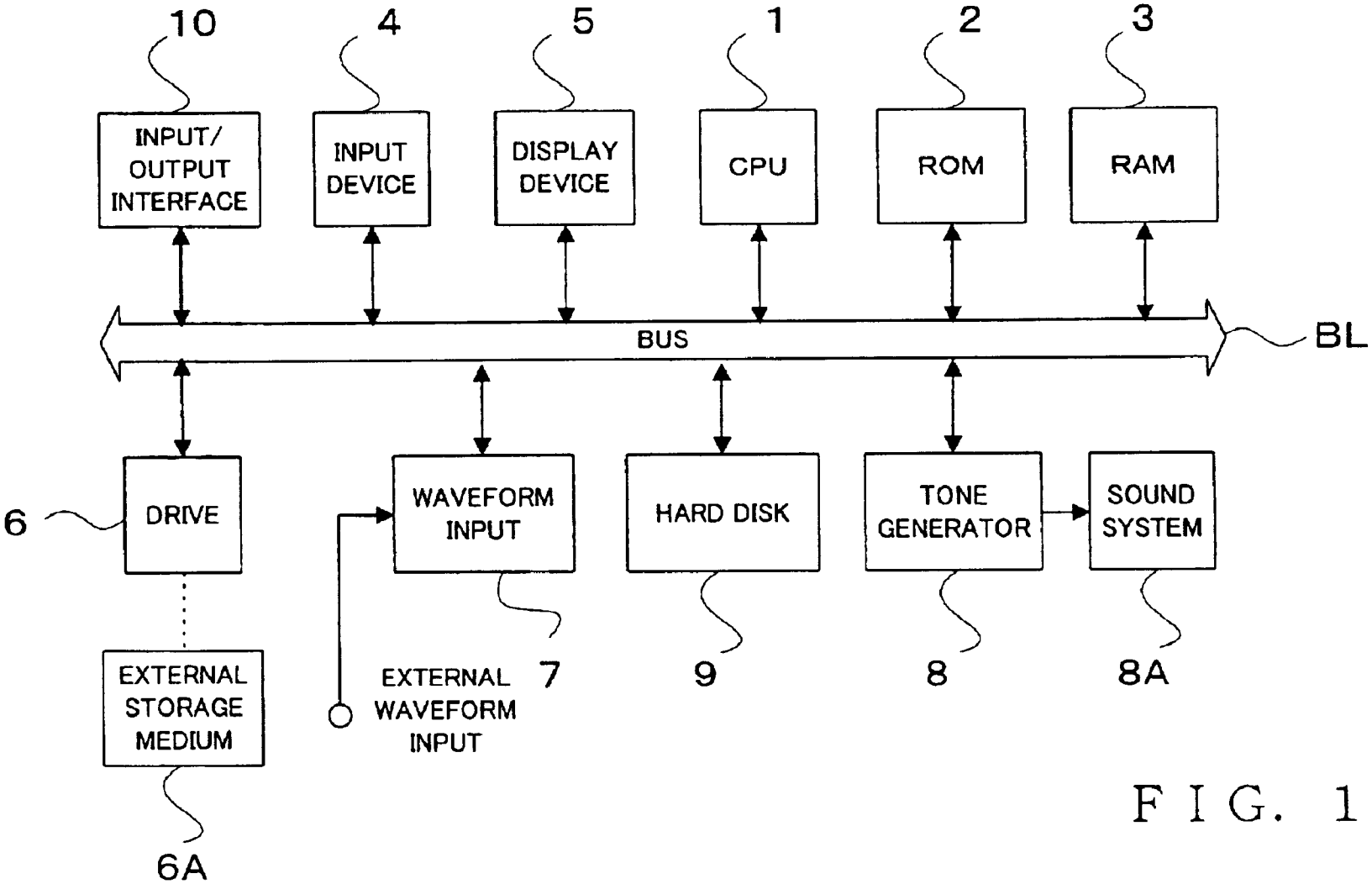
FIG. 1 is a block diagram showing an exemplary hardware organization of a tone generation apparatus in accordance with an embodiment of the present invention.

FIG. 1 is a block diagram showing an exemplary hardware setup of a tone generation apparatus in accordance with an embodiment of the present invention. The hardware organization of the tone generation apparatus illustrated here is implemented using a computer, and predetermined tone generation processing is carried out in the tone generation apparatus by the computer executing predetermined tone generating programs. Of course, the tone generation processing may be implemented by microprograms to be executed by a DSP (Digital Signal Processor), rather than by such computer software. Also, the tone generation processing of the present invention may be implemented by a dedicated hardware apparatus that includes discrete circuits or integrated or large-scale integrated circuitry. Further, the tone generation apparatus of the present invention may be implemented as an electronic musical instrument, karaoke apparatus, electronic game apparatus, multimedia-related apparatus, personal computer or any other desired form of product.

Although the tone generation apparatus of the present invention may include other hardware than the above-mentioned, it will be described hereinafter in relation to a case where minimum necessary resources are employed in the tone generation apparatus.

In FIG. 1, the tone generation apparatus includes a CPU (Central Processing Unit) 1 functioning as a main control section of the computer. Via a bus (e.g., data and address bus) BL, a ROM (Read-Only Memory) 2, a RAM (Random Access Memory) 3, an input device 4, a display device 5, a drive 6, a waveform input section 7, a tone generator section 8, a hard disk 9 and a communication interface 10 are connected to the CPU 1. The CPU 1 carries out various processing, such as the tone generation processing of FIG. 2, on the basis of predetermined programs, as will be later described in detail. These programs are supplied, for example, from an external electronic musical instrument connected via the communication interface 10 to a communication network or from an external recording medium, such as a CD or MO (Magneto-Optical disk) set in the drive 106, and then stored in the hard disk 9. For execution of a desired one of the stored programs, the desired program is loaded from the hard disk 9 into the RAM 3; in an alternative, the programs may be prestored in the ROM 2.

The ROM 2 stores therein various programs and data to be executed or referred to by the CPU 1. The RAM 3 is used as a working memory for temporarily storing various data generated as the CPU 1 executes the programs, or as a memory for storing a currently-executed program and data related to the currently-executed program. Predetermined address regions of the RAM 3 are allocated to various functions and used as various registers, flags, tables, memories, etc. The input device 4 includes various operators for the user to give a tone sampling instruction, edit sampled waveform data (i.e. perform waveform control), select segment templates to be used for the waveform control as will be detailed later, enter various information, etc. Among such operators of the input device 4 are switches for selecting segment templates, a ten-button keypad for entering numerical value data, a keyboard for entering character data and a pointing device like a mouse. The input device 4 may further include operators for selecting, setting and controlling a tone pitch, color, effect and the like of a tone to be generated. The display device 5 visually displays various information entered via the input device 4, sampled waveform data, waveform data having been subjected to waveform control, various segment templates, etc. For example, the display device 5 may be in the form of a liquid crystal display (LCD), cathode ray tube (CRT) and/or the like.

The waveform input section 7, which contains an A/D converter (not shown), samples and converts an analog tone signal, externally input via a microphone or the like, into digital data and then stores the converted digital data onto the hard disk 9 as original waveform data (i.e., waveform data for use as a material for producing a tone waveform). The original waveform data thus stored on the hard disk 9 are then stored into a waveform database and a style-of-rendition database as vector data and style-of-rendition module through predetermined processing. Here, the vector data are stored in the waveform database separately for each of partial waveforms, such as those of an attack portion, body portion, release portion and joint portion, representative of a shape of the input original waveform after being compressed in accordance with a hierarchical compression scheme, rather than being stored in the same form as originally received by the waveform input section 7. The style-of-rendition module includes data for designating vector data, data necessary for restoring the vector data, stored in compressed form, to waveform data of the original waveform shape, etc. Therefore, each style-of-rendition module is stored in the style-of-rendition database as any one of an entrance-related module, finish-related module, joint-related module and body-related module. Specifically, the entrance-related module indicates vector data representing a rising performance section, such as an attack portion, of a tone, the finish-related module indicates vector data representing a falling performance section, such as a release portion, of a tone, the joint-related module indicates vector data representing a performance section, such as a joint portion, interconnecting adjoining tones, and the body-related module indicates vector data representing a performance section of a tone between performance sections represented by the entrance-related module and finish-related module. Each of the entrance-related, finish-related and joint-related modules indicates vector data created from a high-quality waveform having characteristic features, such as a style of rendition (or articulation). The body-related module indicates vector data created from a unit waveform (i.e., loop waveform) of a relatively monotonous tone portion, such as a normal short body (NSB) or vibrato body (VB), having one or a suitable plurality of cycles. Note that each set of vector data, to be used for producing a waveform, is composed of vector elements such as a timbre waveform vector and amplitude envelope vector.

Further, in the tone generation apparatus, the tone generator section 8 is capable of producing a continuous tone waveform by connecting a plurality of sets of vector data, read out from the waveform database, to perform a waveform synthesis process on the vector data sets. To produce such a tone waveform, the tone generator section 8 can perform tone waveform control of a particular performance section of a tone, using any one of various segment templates read out from a segment database, as will be later described in detail. Sound system 8A, including amplifiers and speakers, converts each tone signal, supplied from the tone generator section 8, to an analog signal and then output the analog signal to outside the tone generation apparatus. Of course, the tone generator section 8 is capable of simultaneously outputting a plurality of tone signals. The hard disk 9 is a storage device containing various databases, such as the style-of-rendition database having various style-of-rendition modules cumulatively stored therein, segment database having various segment templates cumulatively stored therein and waveform database having vector data cumulatively stored therein, as well as various software programs for execution by the CPU 1, etc.

It goes without saying that the tone generator section 8 may be implemented by a so-called "software tone generator" that generates tones on the basis of software.

The drive 106 functions to drive a removable external storage medium 6A for storing various data, such as various style-of-rendition modules and/or segment templates, various programs for execution by the CPU 1, etc. The external storage medium 6A to be driven by the drive 6 may be any one of various known removable-type external media, such as a floppy disk (FD), compact disk (CD-ROM or CD-RW), magneto-optical (MO) disk, digital versatile disk (DVD) and semiconductor memory. When the external storage medium 6A having various programs stored therein is set in the drive 6, desired contents (i.e., program) stored in the external storage medium 6A may be loaded directly into the RAM 3, without being first loaded into the hard disk 9. The way of supplying a desired program via the external storage medium 6A or via the input/output interface 10 is very advantageous in that it can greatly facilitate version upgrade of the program, addition of a new program, etc.

Further, the input/output interface 10 is a communication interface connected to a desired communication network, such as a LAN (Local Area Network), the Internet or phone line, via which it may be connected to a desired sever computer or the like (not shown) so as to input a program, any of various style-of-rendition modules, any of various segment templates or performance information to the tone generation apparatus of the invention. Namely, in a case where a particular program, style-of-rendition module or segment template is not contained in the ROM 2 or hard disk 9 of the tone generation apparatus, the particular program, style-of-rendition module or segment template can be downloaded from a server computer via the input/output interface 10 to the tone generation apparatus. In such a case, the tone generation apparatus of the invention, which is a "client", sends a command to request the server computer to download the particular program, style-of-rendition module or segment template. In response to the command from the client, the server computer delivers the requested program, style-of-rendition module or segment template to the tone generation apparatus via the communication network. Then, the tone generation apparatus receives the particular program, style-of-rendition module or segment template from the server computer via the communication network and input/output interface 10 and accumulatively stores the received program, style-of-rendition module or segment template onto the hard disk 9. In this way, the necessary downloading of the particular program, style-of-rendition module or segment template is completed. The input/output interface 10 may be in the form of a MIDI interface, in which case the tone generation apparatus of the present invention communicates MIDI performance information with external MIDI instrument such as an external sequencer or electronic musical instrument. In the case where the input/output interface 10 is a MIDI interface, the tone generation apparatus of the invention may be connected with a music performing keyboard or performance operator equipment so that the music performing keyboard or performance operator equipment can supply MIDI performance information to the tone generation apparatus on a real-time basis.

Figure 2:
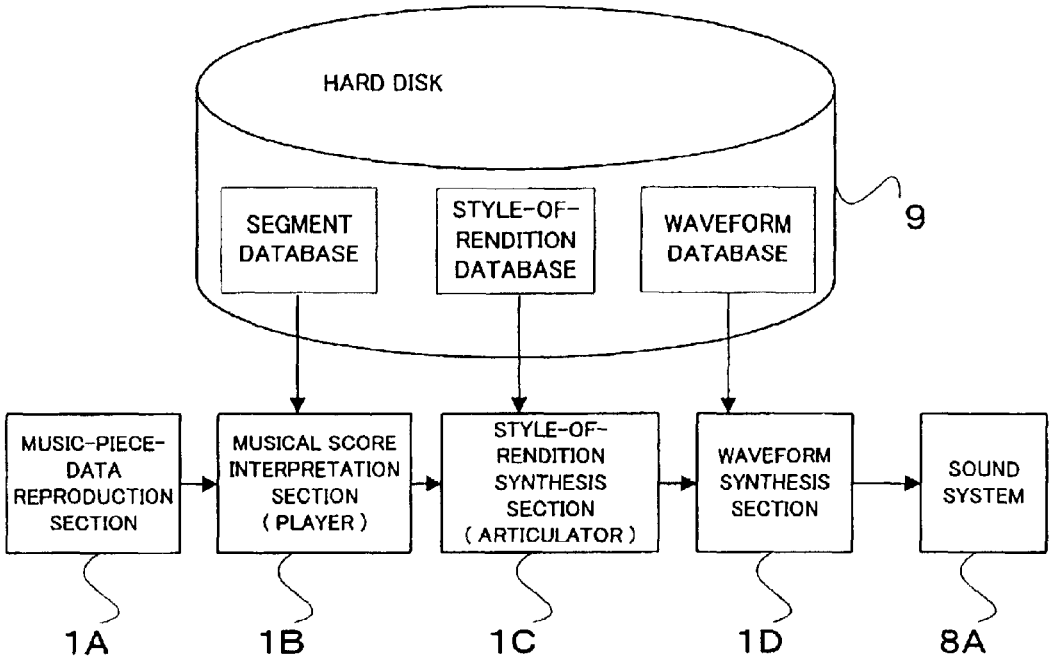
FIG. 2 is a block diagram showing an example of the tone generation apparatus where tone generation processing is performed by a dedicated hardware device.

In the tone generation apparatus of FIG. 1, tones are generated by the computer executing a predetermined software program for performing the tone generation processing. In an alternative, the tone generation processing may be performed by a dedicated hardware device rather than the software program. Detailed description will be made hereinbelow about the tone generation processing carried out by the tone generation apparatus of the present invention with reference to FIG. 2. FIG. 2 is a block diagram showing an example of the tone generation apparatus where the tone generation processing is performed by a dedicated hardware device. With reference to the dedicated hardware device, the tone generation processing will be outlined.

In FIG. 2, a music piece data reproduction section 1A performs a reproduction process for reproducing music piece data imparted with style-of-rendition signs. Namely, the music piece data reproduction section 1A first receives music piece data imparted with style-of-rendition signs (i.e., performance information). In ordinary musical scores, there are written various musical symbols that can not be converted into MIDI data as they are, such as dynamic marks like crescendo and diminuendo, tempo marks like allegro and ritardando, slur symbol, tenuto symbol and accent symbols. Therefore, the music piece data reproduction section 1A converts these musical symbols into data of style-of-rendition signs. MIDI music piece data including such style-of-rendition sign data are referred to as the "music piece data imparted with style-of-rendition signs", and such "music piece data imparted with style-of-rendition signs" are received by the music piece data reproduction section 1A. Musical score interpretation section (player) 1B performs a musical score interpretation process. Specifically, the musical score interpretation section 1B converts MIDI data and "style-of-rendition sign data", included in the received music piece data imparted with style-of-rendition signs, into predetermined style-of-rendition designating information (e.g., style-of-rendition ID and style-of-rendition parameters) and supplies a style-of-rendition synthesis section (articulator) 1C with the converted style-of-rendition designating information along with time information. In creating such style-of-rendition designating information, the musical score interpretation section (player) 1B produces an original envelope based on the performance information (hereinafter referred to as an "input envelope" or "basic envelope"), then produces a synthesized envelope by synthesizing or combining the input envelope (or basic envelope) and various segment templates read out from the segment database in response to a user selection or through an automatic selection process, and then gives the thus-produced synthesized envelope to the style-of-rendition synthesis section (articulator) 1C as style-of-rendition parameters. Generally, even a same musical sign may be interpreted and performed differently (namely, with different styles of rendition or articulation) depending on human players or musical instruments. Further, particular arrangement of notes may be performed differently depending on human players or musical instruments. Thus, the musical score interpretation section 1B is constructed as an expert system of knowledge necessary to interpret such symbols and signs (musical sings and arrangement of notes) on the musical score. The musical score interpretation section 1B interprets the musical score in accordance with predetermined criteria; at that time, the musical score interpretation section 1B interprets the musical score in a specific manner corresponding to designation of a player by the user, e.g. designation of a human player or musical instrument performing the musical score. As an example of a scheme to deal with such different interpretations corresponding to a plurality of players, the instant embodiment stores a plurality of kinds of segment templates in the segment database; the musical score interpretation section 1B determines one or segment templates to be used, in accordance with the player (or musical instrument) designation by the user.

The style-of-rendition synthesis section (articulator) 1C makes reference to the style-of-rendition database, on the basis of predetermined style-of-rendition designating information (style-of-rendition ID and style-of-rendition parameters) converted by the musical score interpretation section 1B, to create a packet stream corresponding to the style-of-rendition designating information and vector parameters related to the packet stream corresponding to the style-of-rendition parameters, and then supplies the thus-created packet stream and vector parameters to a waveform synthesis section 1D. Data to be supplied to the waveform synthesis section 1D as the packet stream include a vector 1D, time information and the like. At that time, the style-of-rendition synthesis section (articulator) 1C reads out style-of-rendition modules from the style-of-rendition database on the basis of the predetermined style-of-rendition designating information and arranges the read-out style-of-rendition modules on a time axis to thereby create a packet stream, and distributively imparts the synthesized envelope, created by the musical score interpretation section (player) 1B, to the style-of-rendition modules arranged on the time axis. Any one of the style-of-rendition modules stored in the style-of-rendition database of the hard disk is specified by a style-of-rendition ID. Contents of the style-of-rendition module specified by the style-of-rendition ID are given as style-of-rendition parameters for characterizing or controlling waveform data corresponding to the style-of-rendition module. The waveform synthesis section 1D sequentially reads out vector data from the waveform database in accordance with the created packet stream, modifies the read-out vector data in accordance with the vector parameters, connects the modified vector data, and then produces a desired tone waveform on the basis of the thus-connected vector data. The sound system 8A audibly reproduces or sound a tone on the basis of the tone waveform produced by the waveform synthesis section 1D.

This and following paragraphs describe the segment template to be used by the musical score interpretation section (player) 1B to synthesize an input or basic envelope, with reference to FIGS. 3A to 3C that are conceptual diagrams illustrating exemplary data construction of the segment templates. Specifically, FIG. 3A shows a note segment template, FIG. 3B shows a table to designate an entrance segment table, and FIG. 3C shows a table to designate a finish segment table. The segment templates are prestored on the hard disk 9 or the like as the segment database which is built as a table. It should be appreciated that these examples of FIGS. 3A to 3C are just illustrative and the present invention is not limited to the illustrated examples.

The note segment template comprises control data to be used to express intonation in the whole of a tone, and, as illustrated in FIG. 3A, a multiplicity of such note segment templates are constructed as a table on the hard disk 9. Each of the note segment templates constituting the table represents a characteristic variation curve to be imparted to the whole of a tone. Namely, each of the note segment templates comprises a set of data assigned a table number and representative of a characteristic variation curve of a predetermined shape. The note segment templates are classified into several types according to the shapes of their respective characteristic variation curves. In the illustrated example, the note segment templates are classified into six major types; that is, table Nos. 0–7 indicate the first-type note segment templates each representing a characteristic variation curve of a substantially linear shape; table Nos. 8–15 indicate the second-type note segment templates each representing a characteristic variation curve of a rising shape; table Nos. 16–23 indicate the third-type note segment templates each representing a characteristic variation curve of a falling shape; table Nos. 24–31 indicate the fourth-type note segment templates each representing a characteristic variation curve of a convex chevron (i.e., mountain) shape; table Nos. 32–39 indicate the fifth-type note segment templates each representing a characteristic variation curve of a concave chevron (i.e., valley) shape; and table Nos. 40–47 indicate the sixth-type note segment templates each representing a characteristic variation curve of a leaping shape.

Namely, the note segment templates, classified into the respective types as noted above, each have a characteristic variation curve of a shape specific to the type. For example, the note segment template of table No. "8", classified as the rising type, comprises data that represent a characteristic variation curve rising with a given inclination. The note segment template of table No. "9" comprises data that represent a characteristic variation curve with its latter half portion rising rapidly as compared to its former half portion. The note segment template of table No. "24", classified as the convex chevron type, comprises data that represent a characteristic variation curve having a peak in its former half portion. Further, the note segment template of table No. "25" comprises data that represent a characteristic variation curve having a peak in its middle portion. Furthermore, in the instant embodiment, the note segment template of table No. "0" is set as default data and has a characteristic variation curve of a complete flat shape. Namely, if the note segment template of table No. "0" is used to modify the input envelope, the waveform of the original input envelope can be reproduced.

Although not shown, phrase segment templates each comprise control data to express intonation in a phrase, such as a measure. These phrase segment templates each have a different time length from the above-mentioned note segment templates but are similar to the note segment templates in other data construction, characteristic variation curve, etc. Therefore, the phrase segment templates will not be described in detail to avoid unnecessary duplication.

Entrance segment templates and finish segment templates each comprise control data having a smaller time length than the above-mentioned note segment templates. Each of the entrance segment templates comprises control data to express intonation in a predetermined segment of a sounding-starting portion of a tone, while each of the finish segment templates comprises control data to express intonation in a predetermined segment of a sounding-ending portion of a tone. The entrance segment templates and finish segment templates are constructed as an entrance segment template designating table and finish segment template designating table, respectively, on the hard disk 9, similarly to the above-described note segment templates. Each of the entrance segment templates constituting the entrance segment template designating table comprises data of a characteristic variation curve to be imparted to a predetermined segment of a sounding-starting portion of a tone and position data (specifically, note-on timing). Each of the finish segment templates constituting the finish segment template designating table comprises data of a characteristic variation curve to be imparted to a predetermined segment of a sounding-ending portion of a tone and position data (specifically, note-off timing). Namely, although not specifically shown, each of the entrance and finish segment templates comprises control data assigned a predetermined table number and having a characteristic variation curve of a predetermined shape. The position data is data that is set at a position of the entrance or finish segment in question which corresponds to the shape of the characteristic variation curve. For example, in the case of an entrance segment of a tone having a slow rise, the position data is set at an appropriate position in a latter half portion of the entrance segment. On the other hand, in the case of an entrance segment of a tone having a rapid rise, the position data is set at an appropriate position in a former half portion of the entrance segment. If the position data is set like this, the entrance and finish segments can be arranged (or placed) on the time axis near note-on and note-off timing, respectively (as will be seen from a later-described process of FIG. 6 directed to arranging the segment templates on the time axis), as a result of which attack and release portions of a tone can be generated at appropriate positions where the user should feel the attack and release phases of the tone.

The characteristic variation curve of each of the entrance segment templates can be specified in accordance with a combination of a time value (e.g., equivalent to or smaller than a quarter note, equivalent to or smaller than a half note, equivalent to or smaller than a whole note, or greater than a whole note), relationship to a preceding tone or note (finish or joint) and initial performing operation intensity (strong, medium, weak or slur). Here, in the case of a string instrument such as a violin, the "initial performing operation intensity" means intensity with which a bow is placed on a string to begin bowing. In the case of a wind instrument such as a saxophone, the "initial performing operation intensity" means intensity of tonguing, and in the case of a keyboard instrument such as a piano, the "initial performing operation intensity" means intensity of key depression. If, in the illustrated example of FIG. 3B, the time value is "equivalent to or smaller than a quarter note", the relationship to a preceding tone or note is "joint" and the initial performing operation intensity is "medium", then the entrance segment template of table No. 68 is selected as an entrance segment template to be applied. On the other hand, the characteristic variation curve of each of the finish segment templates can be specified in accordance with a combination of a time value (e.g., equivalent to or smaller than a quarter note, equivalent to or smaller than a half note, equivalent to or smaller than a whole note, or greater than a whole note), relationship to a following tone or note (entrance or joint) and type of performing style (sticky, ordinary, plain or slur). If, in the illustrated example of FIG. 3C, the time value is "equivalent to or smaller than a whole note", the relationship to a following tone or note is "entrance" and the type of performing style is "plain", then the finish segment template of table No. 48 is selected as a finish template to be applied. As in the case of the above-described note segment templates, each of the entrance and finish segment templates of table No. "0" is set as default data, and if the entrance and finish segment templates of table No. "0" are used to modify the input envelope, then the waveform of the original input envelope can be reproduced.

More specifically, in the instant embodiment, each of the above-described phrase, note, entrance and finish segment templates has a set of characteristic variation curves indicative of four tone factors: dynamics (sustained performance intensity); pitch; vibrato depth; and vibrato speed. Note that the foregoing description has been made only in relation to the segment template related to the dynamics for simplicity of description. Namely, FIG. 3A illustratively shows characteristic variation curves for controlling the dynamics; in fact, however, other segment tables of the pitch, vibrato depth and vibrato speed are prestored in respective tables on the hard disk 9 in combinations with the dynamics-related segment templates of corresponding table numbers, although not specifically shown. With the arrangement that each of the phrase, note, entrance and finish segment templates has a set of four different characteristic variation curves related to the dynamics, pitch, vibrato depth and vibrato speed, the tone generation apparatus of the present invention can perform control, for example, to lower the pitch while progressively raising the dynamics, while interrelating envelopes of the different tone factors. Each of the phrase, note, entrance and finish segment templates having such a set of four different characteristic variation curves related to the dynamics, pitch, vibrato depth and vibrato speed will also be referred to as a "SAT" (Segment Articulation Template). In the instant embodiment, one or more "SATs" (Segment Articulation Templates) are stored in the segment database for each human player or musical instrument. Thus, by designating SATs of a same table number, a different SAT can be used for each human player or musical instrument. Further, merely designating a desired phrase, note, entrance or finish segment template can simultaneously designate respective characteristic variation curves of the dynamics, pitch, vibrato depth and vibrato speed, which can therefore conveniently eliminate a need for designating the characteristic variation curves one by one.

In the instant embodiment, the phrase, note, entrance and finish segment templates are hierarchically organized in accordance with their respective time lengths as noted earlier, and thus it is possible to perform phrase-by-phrase or tone-by-tone fine envelope control by combining appropriate segment templates with an input envelop that is an original envelope possessed by performance information. That is, by using desired phrase and note segment templates in an overlapping fashion, the tone generation apparatus of the present invention can combine the input envelope with the respective characteristic variation curves of the phrase and note segment templates and then perform waveform control for each phrase and tone on the basis of the resultant synthesized envelope, to thereby produce a desired tone waveform. Also, by using a desired entrance segment template in a predetermined segment or part of a beginning portion of a desired note segment template and a desired finish segment template in a predetermined segment or part of an ending portion of the desired note segment template in an overlapping fashion, the tone generation apparatus of the present invention can combine the input envelope with the respective characteristic variation curves of the segment templates and then perform waveform control for each of the predetermined segments of the tone on the basis of the resultant synthesized envelope, to thereby produce a desired tone waveform. Namely, using appropriate combinations of the hierarchically-organized segment templates of different time lengths, the tone generation apparatus of the present invention can perform waveform control per phrase and tone, or per predetermined segment or part of a tone, and it can thereby produce a tone waveform having subtle variations. For better understanding, the following paragraphs describe in detail the waveform control using such segment templates, in relation to some specific examples.

First, a process for determining or setting each segment template to be used is described below. Desired phrase and note segment templates are determined in accordance with a user selection. Because each phrase is effective only for a predetermined performance section beginning with first note-on event data supplied after an instruction has been given for using the phrase segment template (or note-on data supplied at the same time that the instruction has been given), the user selects an appropriate phrase segment template to be used per performance section. As regards each predetermined performance section for which no phrase segment template has been selected by the user, the preset default phrase segment template is used. Further, because each note segment template is effective only for a single tone beginning with first note-on event data supplied after an instruction has been given for using the note segment template (or note-on data supplied at the same time that the instruction has been given), the user selects an appropriate note segment template to be used per tone. As regards each tone for which no note segment template has been selected by the user, the preset default note segment template is used. Namely, where the note segment template of table No. "0", having a characteristic variation curve of a complete flat shape as illustrated in FIG. 3A, is preset as the default, the note segment template of table No. "0" is used per tone for which no note segment template has been selected by the user.

Figure 4:
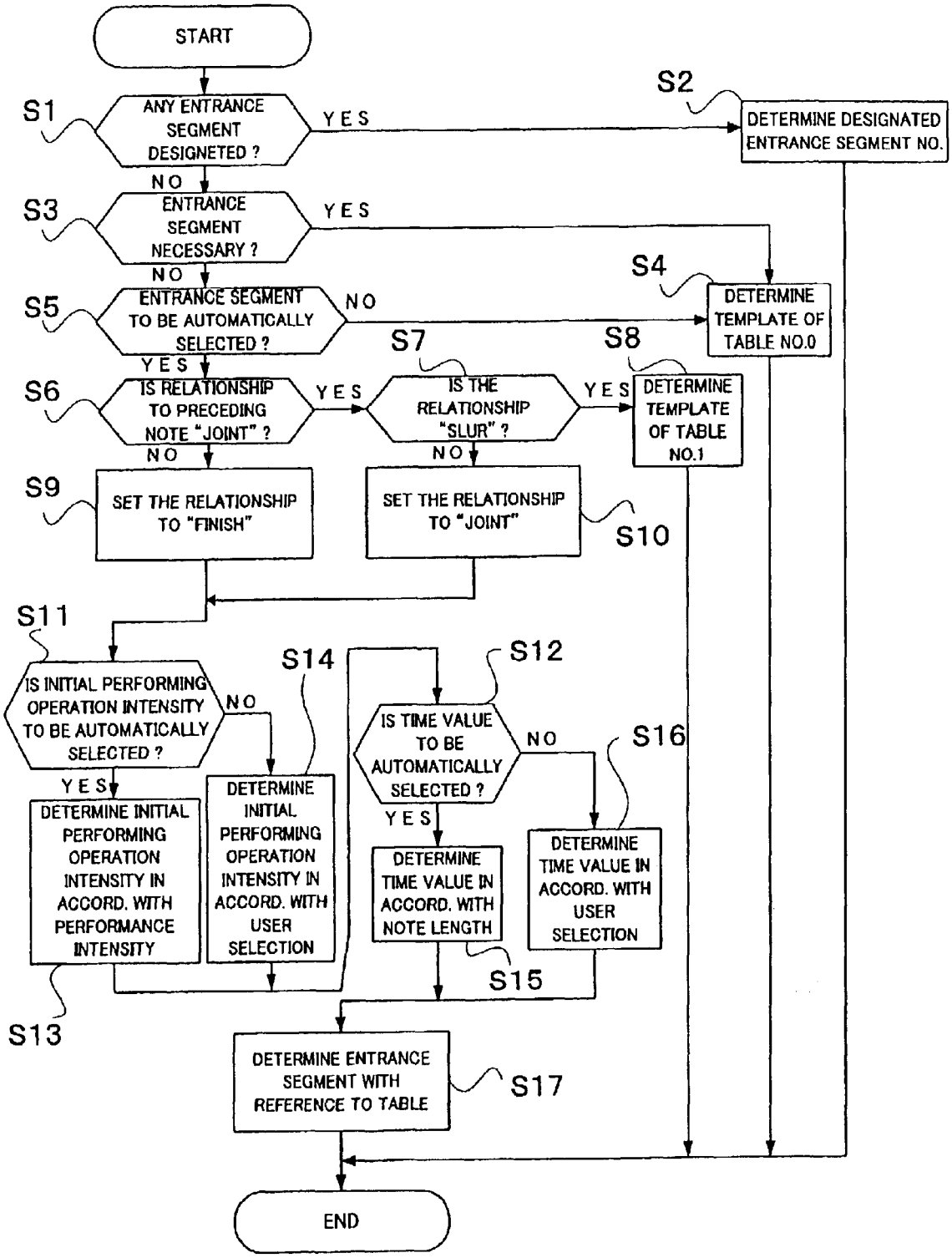
FIG. 4 is a flow cart showing an exemplary step sequence of an automatic entrance-segment-template determining process carried out in the tone generation apparatus.

Entrance and finish segment templates are determined per tone in accordance with a user selection if any, or automatically through a predetermined process if no user selection has been made. Description will be made about processes for setting entrance and finish segment templates, with reference to FIGS. 4 and 5. FIG. 4 is a flow cart showing an exemplary step sequence of the process for automatically setting an entrance segment template (automatic entrance-segment-template determining process).

At step S1 of the automatic entrance-segment-template determining process, a determination is made as to whether any entrance segment template has been selected by designation of a table number or the like. If answered in the affirmative (YES determination at step S1), the process determines the entrance segment template selected by the designation of the table number, at step S2. If, on the other hand, no entrance segment template has been selected (NO determination at step S1), it is further determined at step S3 whether no entrance segment template is necessary for a note in question, i.e. whether no control has to be performed on a rising portion of the tone. If no entrance segment template, i.e. no waveform control based on an entrance segment template, is necessary for the note in question as determined at step S3, the entrance segment template of table number "0" is determined as a template to be applied (i.e., no SAT is used in this case), at step S4. Namely, in this case, because the entrance segment template having a flat characteristic variation curve is determined as a template to be applied, no control is performed on the rising portion of the tone. If, on the other hand, step S3 has determined that an entrance segment template, i.e. waveform control based on an entrance segment template, is necessary, it is further determined at step S5 whether any setting has been made for executing an automatic selection of an entrance segment template. If no setting has been made for executing the automatic selection (NO determination at step S5), the entrance segment template of table number "0" is determined as a template to be applied (i.e., no SAT is used in this case), at step S4. If, on the other hand, the setting has been made for executing the automatic selection (YES determination at step S5), a further determination is made at step S6 as to whether or not the relationship to a preceding note is "joint". If the relationship to a preceding note is not "joint" (NO determination at step S6), the relationship to a preceding note is set to "finish" at step S9. If, on the other hand, the relationship to a preceding note is "joint" (YES determination at step S6), it is further determined at step S7 whether or not the relationship to a preceding note is "slur". With a NO determination at step S7, the relationship to a preceding note is set to "joint" at step S10. If, on the other hand, the relationship to a preceding note is "slur" (YES determination at step S7), then the entrance segment template of table number "1" (i.e., slur controlling data) is determined as a template to be applied, at step S8.

At next step S11, a determination is made as to whether the initial performing operation intensity of the entrance segment template is to be automatically selected. If answered in the affirmative at step S11, initial performing operation intensity of the entrance segment template is determined in accordance with performance intensity (in particular, velocity of the tone in the case of MIDI data), at step S13. If the type of the entrance segment template is not to be automatically selected (NO determination at step S11), then initial performing operation intensity (strong, medium, weak or slur) of the entrance segment template pre-selected by the user is determined at step S14. At next step S12, a further determination is made as to whether the length of the entrance segment template is to be automatically selected. If the length of the entrance segment template is to be automatically selected (YES determination at step S12), a length of the entrance segment template is determined in accordance with the length of the note at step S15. With a NO determination at step S12, a length of the entrance segment template pre-selected by the user is determined at step S16. Namely, entrance segment templates to be used for waveform control of respective rising portions of notes are determined with reference to the thus-set relationship to a preceding note (see steps S9 and S10) and type (see steps S13 and S14) and length (see steps S15 and S16) of entrance segment template.

Figure 5:
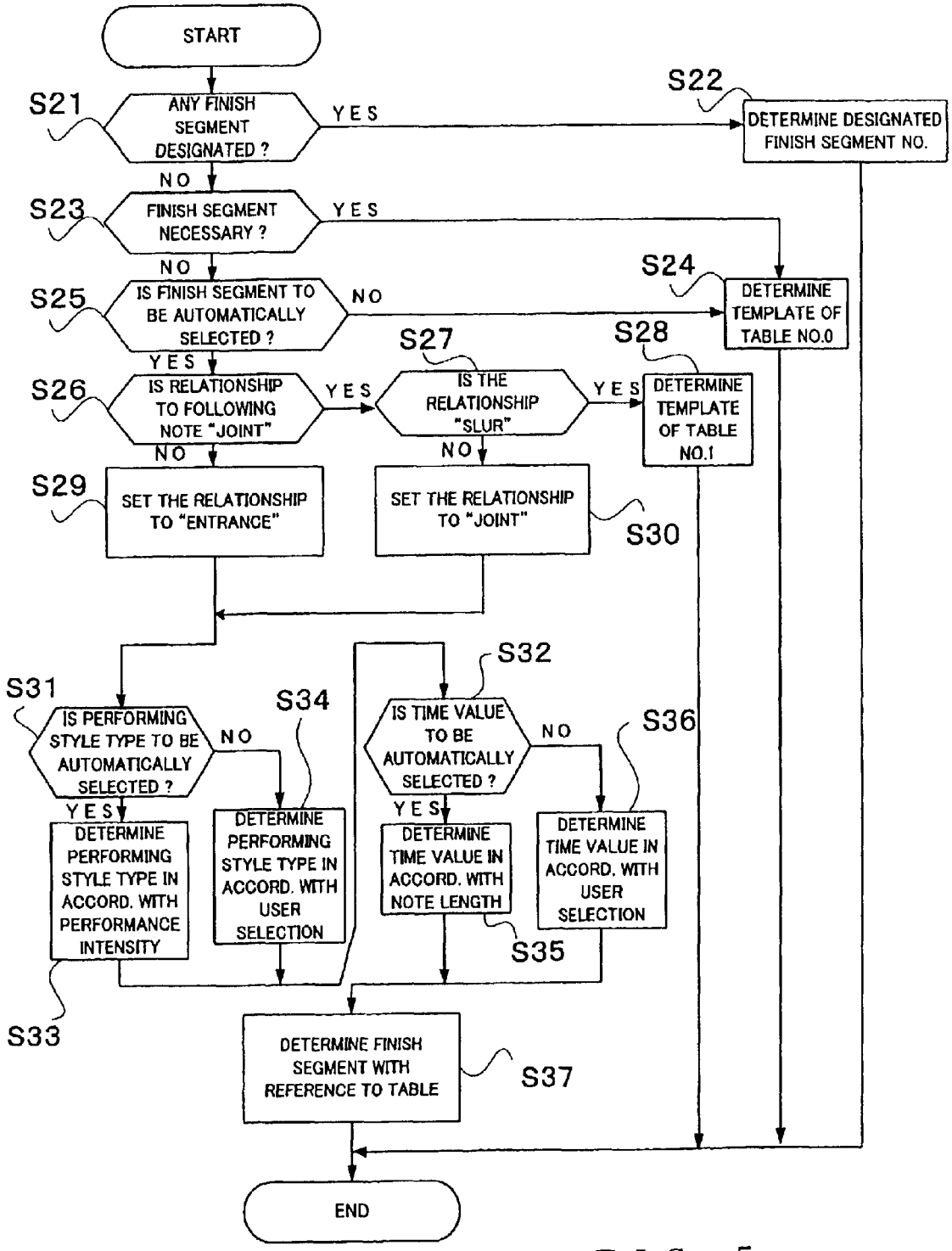
FIG. 5 is a flow cart showing an exemplary step sequence of an automatic finish-segment-template determining process carried out in the tone generation apparatus.

Description will be now made about the process for setting a finish segment template, with reference to FIG. 5. FIG. 5 is a flow cart showing an exemplary step sequence of the process for automatically setting a finish segment template (automatic finish-segment-template determining process).

At step S21 of the automatic finish-segment-template determining process, a determination is made as to whether any finish segment template has been selected by designation of a table number or the like. If answered in the affirmative (YES determination at step S21), the finish-segment-template determining process determines the finish segment template selected by the designation of the table number, at step S22. If, on the other hand, no finish segment template has been selected (NO determination at step S21), it is further determined at step S23 whether no finish segment template is necessary for a note in question, i.e. whether no control has to be performed on a falling portion of the tone. If no finish segment template, i.e. no waveform control based on a finish segment template, is necessary for the note in question as determined at step S23, the finish segment template of table number "0" is determined as a template to be applied (i.e., no SAT is used in this case), at step S24. Namely, in this case, because the finish segment template having a flat characteristic variation curve is determined as a template to be applied, no control is performed on the falling portion of the tone. If, on the other hand, step S23 has determined that a finish segment template, i.e. waveform control based on a finish segment template, is necessary, it is further determined at step S25 whether any setting has been made for executing an automatic selection of a finish segment template. If no such setting has been made for executing the automatic selection (NO determination at step S25), the finish segment template of table number "0" is determined as a template to be applied (i.e., no SAT is used in this case), at step S24. If, on the other hand, the setting has been made for executing the automatic selection (YES determination at step S25), a further determination is made at step S26 as to whether or not the relationship to a following note is "joint". With a NO determination at step S26, the relationship to a following note is set to "entrance" at step S29. If, on the other hand, the relationship to a following note is "joint" (YES determination at step S26), it is further determined at step S27 whether or not the relationship to a following note is "slur". With a NO determination at step S27, the relationship to a following note is set to "joint" at step S30. If, on the other hand, the relationship to a following note is "slur" (YES determination at step S27), then the finish segment template of table number "1" (i.e., slur controlling data) is determined as a template to be applied, at step S28.

At next step S31, a determination is made as to whether the type of the finish segment template is to be automatically selected. If answered in the affirmative at step S31, a type of the finish segment template is determined in accordance with velocity of the tone, at step S33. If the type of the finish segment template is not to be automatically selected (NO determination at step S31), then a type of the finish segment template pre-selected by the user is determined at step S34. At next step S32, a determination is made as to whether the length of the finish segment template is to be automatically selected. If the length of the finish segment template is to be automatically selected (YES determination at step S32), a length of the finish segment template is determined in accordance with the length of the note at step S35. With a NO determination at step S32, a length of the finish segment template pre-selected by the user is determined at step S36. Namely, finish segment templates to be used for waveform control of respective falling portions of notes are determined with reference to the thus-set relationship to a preceding note (see steps S29 and S30) and type (see steps S33 and S34) and length (see steps S35 and S36) of finish segment template.

Namely, in the instant embodiment, when no designation has been made by the user, each of entrance and finish segment templates is automatically selected on the basis of connecting relationships with preceding and following notes, performance intensity in the portion where the segment template is to be applied, and tone length in the portion where the segment template is to be applied. It should also be noted that the automatic selection criteria are not limited to the above-mentioned; for example, a tone pitch in the portion where the segment template is to be applied may also be used as an automatic selection criterion. With the above-described arrangement that a segment template to be used for waveform control is automatically determined when the user has selected no segment template, the instant embodiment can eliminate the need for the user to select entrance and finish segment templates per note throughout the music piece. As a result, the user is allowed to perform efficient waveform control.

Figure 6A:
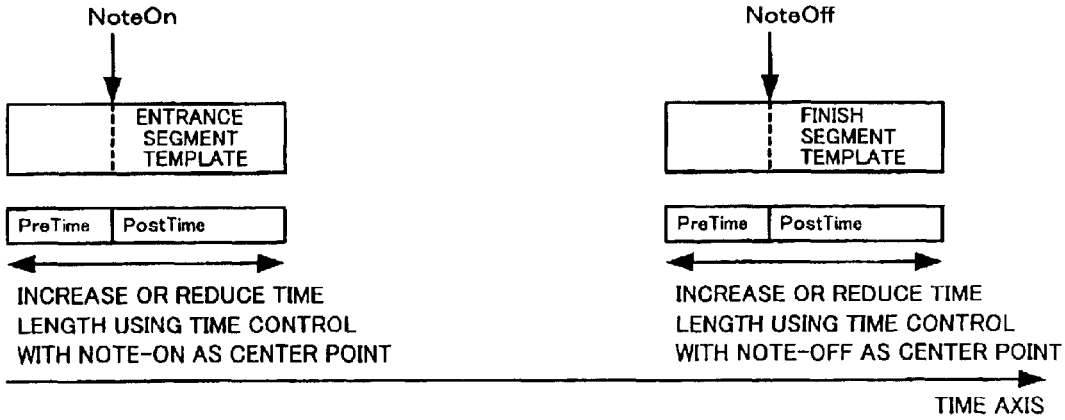
FIGS. 6A and 6B are conceptual diagrams explanatory of an arrangement process for arranging segment templates on a time axis.
Figure 6B:
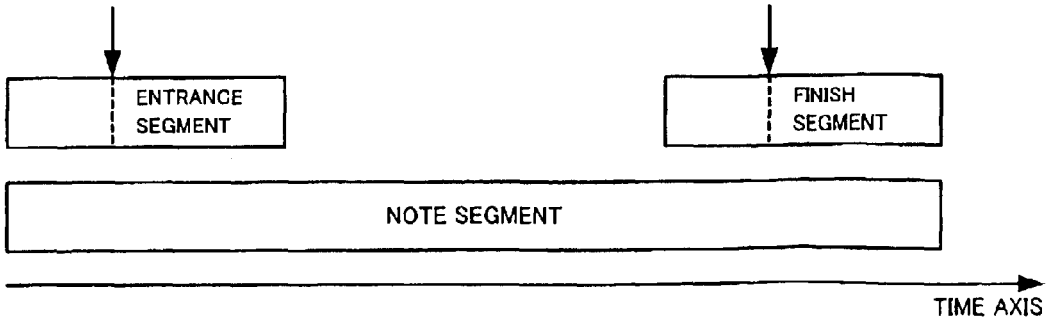
Figure 7:
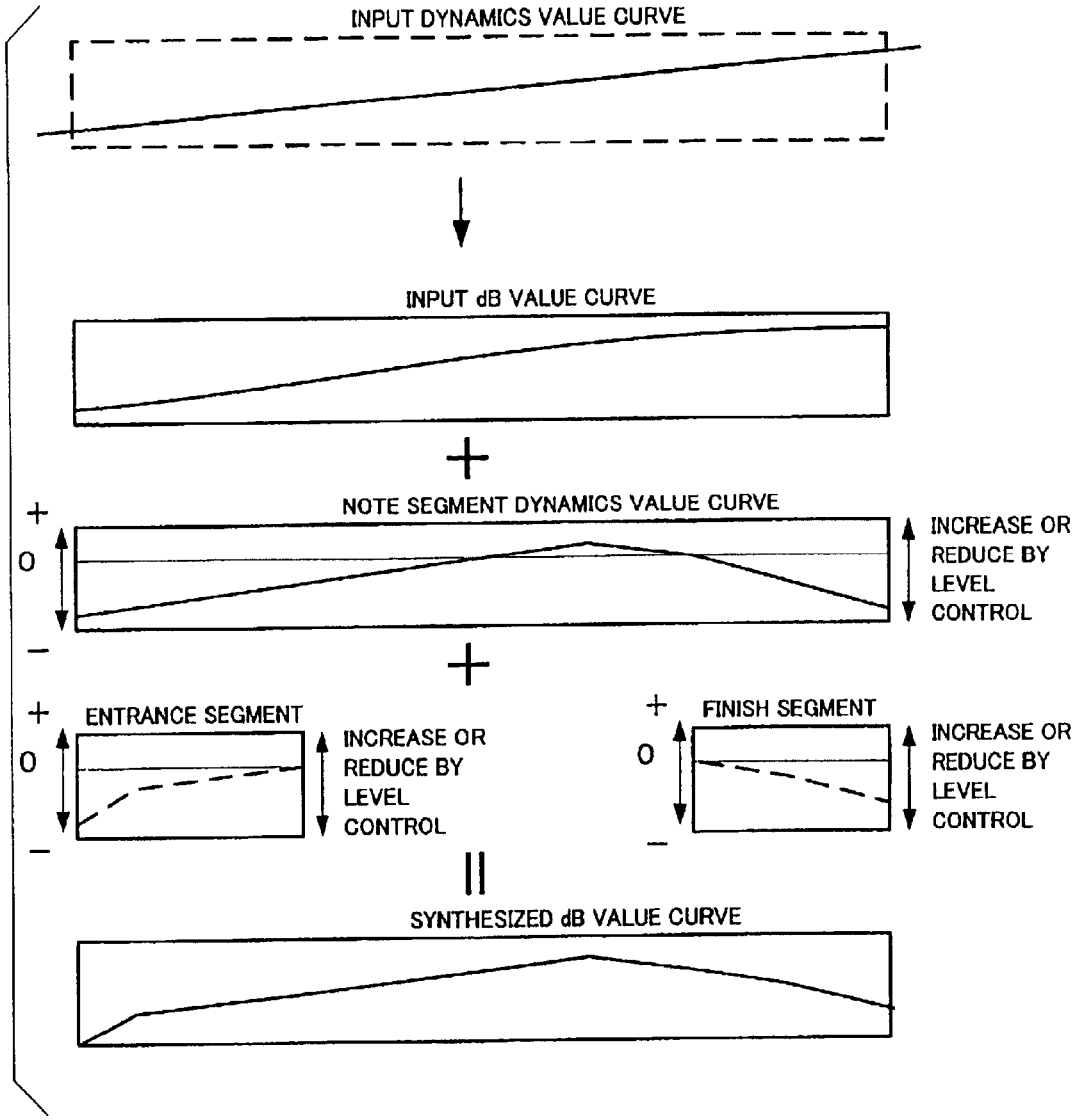
FIG. 7 is a conceptual diagram explanatory of envelope synthesis executed by combining segment templates.

Once the segment templates to be used for waveform control have been determined in accordance with the user selection or through the automatic processes as described above, the thus-determined segment templates are placed or arranged on the time axis, the thus-arranged segment templates are combined with the input envelope. Then, waveform control is performed by applying the resultant synthesized envelope to individual style-of-rendition modules, to thereby produce a desired tone waveform. With reference to FIGS. 6 and 7, a description will be made on the arrangement, on the time axis, of the determined segment templates and the synthesis of the input envelope performed on the basis of the arranged segment templates. The following paragraphs describe processes performed on a single note for arranging, on the time axis, of the determined segment templates and combining the arranged segment templates with the input envelope. Namely, these arrangement and synthesis processes are carried out in the instant embodiment per note.

First, the arrangement process for arranging the determined segment templates on the time axis is explained. FIGS. 6A and 6B are conceptual diagrams explanatory of the segment template arrangement process. Specifically, FIG. 6A is explanatory of a manner in which entrance and finish segment templates are arranged on the time axis, while FIG.

6B is explanatory of a manner in which a note segment template is arranged on the time axis.

The entrance and finish segment templates are first arranged on the time axis, as illustrated in FIG. 6A. Specifically, the entrance segment template is arranged on the time axis near note-on event timing in such a manner that the note-on timing preset in the entrance segment template coincides with predetermined note-on event timing. On the other hand, the finish segment template is arranged on the time axis near note-off event timing in such a manner that the note-off timing preset in the finish segment template coincides with predetermined note-off event timing. At that time, the respective time lengths of the entrance and finish segment templates are increased or reduced, using, for example, predetermined time control parameters so that the respective variation curves of the entrance and finish segment templates can be expanded or contracted in the time-axial direction. More specifically, the respective time lengths of the entrance and finish segment templates are increased or reduced with the note-on timing or note-off timing used as a center point of the time length increase or reduction. For example, if a portion preceding the note-on timing or note-off timing of the entrance and finish segment templates is set as a pre-timing (pre-time) portion and a portion following the note-on timing or note-off timing of the entrance and finish segment templates is set as a post-timing (post-time) portion, the preceding portion and following portion of each of the entrance and finish segment templates can be expanded or contracted separately from each other by individually controlling the pre-timing portion and post-timing portion. By allowing the user to edit the time lengths of the segment templates as desired in the above-described manner, the user can apply the individual arranged segment templates to desired portions of the note after having customized the arranged segment templates in the time-axial direction.

After the entrance and finish segment templates have been arranged on the time axis, a note segment template is arranged on the time axis on the basis of the already-arranged entrance and finish segment templates. Specifically, the note segment template is arranged on the time axis in such a manner that the start point and end point of the note segment template coincide with the start point of the entrance segment template and the end point of the finish segment template, respectively. Namely, the time length of the note segment template is increased or reduced in conformity with the time length from the start point of the already-arranged entrance segment template to the end point of the already-arranged finish segment template. In this way, the entrance and finish segment templates and the note segment template are arranged on the time axis in overlapping relation.

Next, the envelope synthesis executed by combining segment templates is explained, with reference to FIG. 7. Here, the envelope synthesis is described in relation to the "dynamics (amplitude)" among the four envelope factors, i.e. dynamics, pitch, vibrato depth and vibrato speed. Namely, FIG. 7 illustrates, in a top-to-bottom direction, a dynamics value curve of an input (or basic) envelope to be generated on the basis of MIDI input, an input decibel (dB) value curve calculated from the dynamics value curve of the input (or basic) envelope to be generated on the basis of the MIDI input, a dB value curve of dynamics of a note segment template, dynamics dB value curves of entrance and finish segment templates, and an input dB curve of a synthesized result.

The dynamics value curve input as MIDI information (i.e., input or basic envelope) is converted into dB values (hereinafter called an input dB value curve) in accordance with a key number of the note in question and using dynamics scale data assigned to the musical score interpretation section (player) 1B. Note, entrance and finish segment templates are added to an input dB value curve calculated from the converted dB values. At that time, the level of each of the note, entrance and finish segment templates is increased or reduced in accordance with a predetermined level control parameter, so that the shape of the characteristic variation curve of the segment template can be varied along a direction or axis of levels. The above-mentioned level control parameter may be designated either by the user directly entering a numerical value at a predetermined position (e.g., preset representative point characterizing the shape of the characteristic variation curve) or by the user vertically moving the representative point of the characteristic variation curve displayed on the display device 5. By thus editing the levels of the segment templates, the user can customize the segment templates along the axis of levels. Then, the note, entrance and finish segment templates are added to the input dB value curve, by which the segment templates are synthesized relative to each other so that a characteristic synthesized dB value curve can be created. The thus-created synthesized dB value curve is passed, as Amplitude Shift or Dynamics information, to the musical score interpretation section (player) 1B.

Of course, for each of the other envelope factors (pitch, vibrato depth and vibrato speed), a synthesized envelope is created by arithmetically operating the predetermined input envelope with note, entrance and finish segment templates, in a similar manner to the dynamics envelope synthesis having been set forth above. Further, it goes without saying that level control can be performed on the envelope of each of the other envelope factors (pitch, vibrato depth and vibrato speed) in a similar manner to the level control of the dynamics envelope.

Namely, in the instant embodiment, a single synthesized envelope is produced by the note, entrance and finish segment templates (and phrase segment template) relatively acting on the input envelope.

Figure 8A:
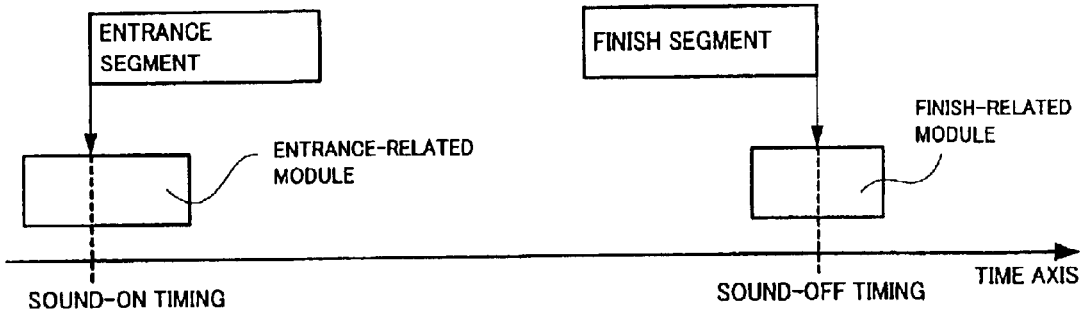
FIGS. 8A and 8B are conceptual diagrams explanatory of manners in which the style-of-rendition modules are arranged on the time axis and a synthesized envelope is imparted to the style-of-rendition modules.
Figure 8B:
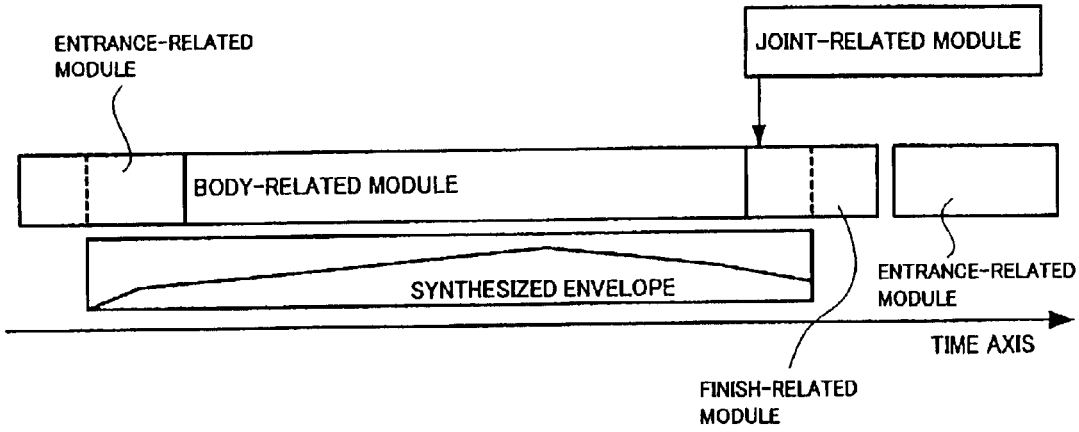

The synthesized envelope produced by the musical score interpretation section (player) 1B, i.e. the synthesized envelope calculated by operating the input envelope with various segment templates, such as the note, entrance and finish segment templates, is given to the style-of-rendition synthesis section (articulator) 1C as style-of-rendition parameters. Then, the style-of-rendition synthesis section (articulator) 1C reads out style-of-rendition modules from the style-of-rendition database on the basis of predetermined style-of-rendition designating information (style-of-rendition ID and style-of-rendition parameters), and creates a packet stream by imparting the thus read-out style-of-rendition modules with the synthesized envelope produced by the musical score interpretation section (player) 1B (see FIG. 2). With reference to FIGS. 8A and 8B, the following paragraphs describe a manner in which, for packet stream creation by the style-of-rendition synthesis section 1C, the style-of-rendition modules are arranged on the time axis and the synthesized envelope is distributively imparted to the style-of-rendition modules. Specifically, FIG. 8A is a conceptual diagram explanatory of the manner in which the entrance-related and finish-related modules are arranged on the time axis, while FIG. 8B is a conceptual diagram explanatory of the manner in which the body-related and joint-related modules are arranged on the time axis and the synthesized envelope is distributively imparted to the style-of-rendition modules.

As illustrated in FIG. 8A, the style-of-rendition synthesis section 1C first reads out entrance-related and finish-related modules from the style-of-rendition database on the basis of predetermined style-of-rendition designating information (style-of-rendition ID and style-of-rendition parameters), and arranges the read-out entrance-related and finish-related modules in predetermined time positions on the time axis. Specifically, the entrance-related module is placed (or arranged) in the time position on the time axis in such a manner that sound-on timing of the entrance-related module coincides with the start point of the entrance segment template. Here, the "sound-on timing" is recorded in the entrance-related module as a time from the beginning of the style-of-rendition module. On the other hand, the finish-related module is placed (or arranged) in a predetermined position on the time axis in such a manner that sound-off timing of the finish-related module coincides with the end point of the finish segment template. The sound-off timing is recorded in the finish-related module as a time from the beginning of the module. Then, as illustrated in FIG. 8B, the body-related module is arranged on the time axis between the entry-related module and the finish-related module having already been arranged on the time axis. If a time interval between the entry-related module and the finish-related module arranged on the time axis is not greater than a predetermined value, then a Normal Short Body (NSB) is arranged as the body-related module, while if the time interval between the entry-related module and the finish-related module is greater than the predetermined value, a Vibrato Body (VB) is arranged as the body-related module. However, in case no body-related module can be placed between the entry-related module and the finish-related module, the placement of a body-related module may be omitted. Then, if a time interval between next note-on timing and note-off timing is not greater than a predetermined value, a joint-related module is inserted between the body-related module and a next body-related module. In this way, various style-of-rendition modules are sequentially arranged on the time axis. Of course, in a case where modules to be used have been selected directly by the user, such selected modules may be used instead of the above-mentioned.

Further, as illustrated in FIG. 8B, the synthesized envelope, produced by the musical score interpretation section 1B arithmetically operating the input envelope with the various segment templates, such as the note, entrance and finish segment templates, in accordance with the respective positions of the arranged style-of-rendition modules is acquired, and the thus-acquired synthesized envelope is distributively imparted to the individual style-of-rendition modules to thereby create a packet stream. The thus-created packet stream is supplied to the waveform synthesis section 1D, and the waveform synthesis section 1D can modify vector data (i.e., partial waveforms represented by the style-of-rendition modules), retrieved from the waveform database on the basis of the packet stream, in accordance with the synthesized envelope. Then, the waveform synthesis section 1D can produce a desired tone waveform by connecting the thus-modified partial waveforms. Namely, by modifying the individual style-of-rendition modules in accordance with the imparted synthesized envelope and connecting the partial waveforms of the thus-modified style-of-rendition modules, it is possible to produce a tone waveform of a shape corresponding to the respective characteristic variation curves imparted as the segment templates.

The style-of-rendition synthesis section 1C reflects the synthesized envelope, produced by the musical score interpretation section 1B in the above-described manner, not only in the packet stream but also as vector data. Namely, to create vector parameters, the style-of-rendition synthesis section 1C may generate vector parameters distributively imparted with the synthesized envelope generated by the musical score interpretation section 1B. In such a case, the waveform synthesis section 1D can generate a tone with a dynamics envelope reflected therein, by sequentially retrieving vector data from the waveform database in accordance with the created packet stream, modifying the vector data in accordance with the vector parameters and then connecting together the partial waveforms of the modified vector data. Of course, for each of the other factors, i.e. pitch, vibrato depth and vibrato speed, a tone with a corresponding envelope reflected therein can also be generated in a similar manner to the dynamics envelope.

As set forth above, the tone generation apparatus of the present invention can modify phrase-by-phrase or note-by-note tone expression by use of hierarchical templates of different time lengths, such as the phrase, note, entrance and finish segment templates, with the result that it can readily produce a tone waveform of a complicated variation shape, particularly in a performance section of a tone, such as an attack or release portion. By synthesizing dynamics envelopes represented by the individual segment templates and then combining the thus-synthesized dynamics envelopes with an envelope of each tone, the tone generation apparatus of the present invention can generate an entire dynamics envelope. Further, because each of the phrase, note, entrance and finish segment templates has a set of characteristic variation curves (i.e., envelope curves) related to the dynamics, pitch, vibrato depth and vibrato speed, the user can perform waveform control of the pitch, vibrato depth and vibrato speed as well as the dynamics, by only designating a style of rendition. In an alternative, an envelope may be synthesized by combining only the segment templates, without generating an original input envelope (basic envelope) based on performance information.

In the case where the tone generation apparatus of the present invention as described above is applied to an electronic musical instrument, the electronic musical instrument may be other than the keyboard type instrument, such as a stringed, wind or percussion type musical instrument. In such a case, the present invention is of course applicable not only to such an electronic musical instrument where all of the music piece data reproduction section 1A, musical score interpretation section 1B, style-of-rendition synthesis section 1C, waveform synthesis section 1D and the like are incorporated together as a unit within the body of the musical instrument, but also to another type of electronic musical instrument where the above-mentioned sections are provided separately and interconnected via communication facilities such as a MIDI interface, communication network and the like. Further, the tone generation apparatus of the present invention may comprise a combination of a personal computer and application software, in which case various processing programs may be supplied to the tone generation apparatus from a storage media, such as a magnetic disk, optical disk or semiconductor memory, or via a communication network. Furthermore, the tone generation apparatus of the present invention may also be applied to automatic performance apparatus such as a player piano.

To summarize, in order to produce a tone waveform in accordance with an envelope synthesized using a selected combination of segment templates each comprising a set of different kinds of characteristic variation curves to be imparted to a particular performance section of a tone, the present invention can change the shape of the characteristic variation curve of each of the selected segment templates in accordance with a level and time length. Therefore, the present invention affords the superior benefit that the user is allowed to readily produce a tone waveform while finely controlling the waveform per predetermined portion of a tone.

Further, according to the present invention, templates of characteristic variation curves to be imparted to a particular performance section of a phrase or tone are prepared beforehand, an envelope is synthesized using a combination of two or more of the prepared templates that correspond to a desired one of the different time lengths, and then a tone waveform is produced in accordance with the thus-synthesized envelope. Therefore, the present invention advantageously allows the user to readily perform fine waveform control to achieve more delicate musical expression by just using a suitable combination of the segment templates of a desired one of the different time lengths.

Furthermore, according to the present invention, a suitable combination of segment templates, each comprising a set of different kinds of characteristic variation curves to be imparted to a particular performance section of a tone, is combined with an input envelope, and a tone waveform is produced in accordance with a resultant synthesized envelope. Namely, the present invention can control the input envelope per selected segment template; thus, the user is allowed to readily perform waveform control of a particular performance section of a tone, using such a segment template.

The present invention relates to the subject matter of Japanese Patent Application Nos. 2001-353006, 2001-357007 and 2001-353010 filed on Nov. 19, 2001, the disclosure of which is expressly incorporated herein by reference in its entirety.

What is claimed is:

1. A tone generation apparatus comprising:

a performance information supply section that supplies performance information;

a segment template supply section that supplies a segment template including a partial characteristic variation curve and position information;

an envelope synthesis section that produces a basic envelope for at least one tone on the basis of the performance information, arranges, on a time axis based on the performance information, the characteristic variation curve of the segment template in accordance with the position information and combines the characteristic variation curve, arranged on the time axis, with the basic envelope, to thereby produce a synthesized envelope for the at least one tone; and a tone generation section that generates a tone using the synthesized envelope produced by said envelope synthesis section.

2. A tone generation apparatus as claimed in claim 1 wherein the segment template includes a set of characteristic variation curves related to a plurality of kinds of tone factors, and wherein said envelope synthesis section produces respective basic envelopes of the plurality of kinds of tone factors on the basis of the performance information, combines the produced respective basic envelopes with the characteristic variation curves of the corresponding tone factors, and thereby produces respective synthesized envelopes of the plurality of kinds of tone factors.

3. A tone generation apparatus as claimed in claim 1 wherein said envelope synthesis section arranges the characteristic variation curve on the time axis, in accordance with the position information of the segment template, on the basis of note-on or note-off timing included in the performance information.

4. A tone generation apparatus as claimed in claim 1 wherein the segment template includes a characteristic variation curve that characterizes a portion of a tone, such as an attack or release portion of the tone.

5. A tone generation apparatus as claimed in claim 1 wherein the segment template includes a plurality of characteristic variation curves, and a characteristic variation curve selected from among the plurality of characteristic variation curves is used to produce the synthesized envelope.

6. A tone generation apparatus as claimed in claim 1 wherein said envelope synthesis section can modify the characteristic variation curve placed on the time axis based on the performance information.

7. A tone generation apparatus as claimed in claim 1 wherein said segment template supply section includes a memory storing a plurality of segment templates.

8. A tone generation method comprising:

a step of supplying performance information;

a step of supplying a segment template including a partial characteristic variation curve and position information;

a step of producing a basic envelope for at least one tone on the basis of the performance information, arranges, on a time axis based on the performance information, the characteristic variation curve of the segment template in accordance with the position information and combining the characteristic variation curve arranged on the time axis with the basic envelope, to thereby produce a synthesized envelope for the at least one tone; and a step of generating a tone using the produced synthesized envelope.

9. A computer program containing a group of instructions to cause a computer to perform a tone generation method, said tone generation method comprising:

supplying performance information;

supplying a segment template including a partial characteristic variation curve and position information;

producing a basic envelope for at least one tone on the basis of the performance information, arranges, on a time axis based on the performance information, the characteristic variation curve of the segment template in accordance with the position information and combining the characteristic variation curve arranged on the time axis with the basic envelope, to thereby produce a synthesized envelope for the at least one tone; and generating a tone using the produced synthesized envelope.

10. A tone generation apparatus comprising:

a performance information supply section that supplies performance information;

a segment template supply section that is capable of supplying a plurality of segment templates of different lengths, each of the segment templates including a characteristic variation curve;

an envelope synthesis section that arranges the characteristic variation curves of two or more segment templates of different lengths, in correspondence with a given performance section based on the performance information, in such a manner that at least parts of the characteristic variation curves of the two or more segment templates overlap with each other, and produces a synthesized envelope for the given performance section by combining the arranged characteristic variation curves; and a tone generation section that generates a tone using the synthesized envelope produced by said envelope synthesis section.

11. A tone generation apparatus as claimed in claim 10 wherein said envelope synthesis section produces the synthesized envelope by first producing a basic envelope on the basis of the performance information and then combining the produced basic envelope with the placed characteristic variation curves.

12. A tone generation apparatus as claimed in claim 10 wherein the plurality of segment templates of different lengths capable of being supplied by said segment template supply section include a phrase segment template corresponding to a length of a phrase, a note segment template corresponding to a substantial total length of a tone, and a tone-portion segment template corresponding to a length of a portion of a tone.

13. A tone generation apparatus as claimed in claim 10 wherein each of the plurality of segment templates of different lengths includes a set of characteristic variation curves related to a plurality of kinds of tone factors, and wherein said envelope synthesis section produces respective synthesized envelopes of the plurality of kinds of tone factors by combining the characteristic variation curves of the plurality of kinds of tone factors.

14. A tone generation apparatus as claimed in claim 10 wherein said envelope synthesis section arranges each of the characteristic variation curves on the basis of note-on or note-off timing included in the performance information.

15. A tone generation apparatus as claimed in claim 10 wherein at least one of the two or more segment templates of different lengths to be combined by said envelope synthesis section includes position information, and said envelope synthesis section arranges the at least one segment template in the given performance section in accordance with the position information.

16. A tone generation apparatus comprising:

a performance information supply section that supplies performance information;

a segment template supply section that is capable of supplying segment templates each including a characteristic variation curve, the segment templates including note segment templates corresponding to substantial total lengths of tones and tone-portion segment templates corresponding to lengths of tone portions;

an envelope synthesis section that, in correspondence with a given performance section of a tone based on the performance information, selects one note segment template and one or more tone-portion segment templates, arranges the selected note segment templates in the given performance section of the tone and the selected tone-portion segment templates in a part of the given performance section of the tone, and produces a synthesized envelope for the given performance section by combining respective characteristic variation curves of the arranged segment templates; and a tone generation section that generates a tone using the synthesized envelope produced by said envelope synthesis section.

17. A tone generation method comprising:

a step of supplying performance information;

a step of supplying a plurality of segment templates of different lengths, each of the segment templates including a characteristic variation curve;

a step of arranging two or more segment templates of different lengths, in correspondence with a given performance section based on the performance information, in such a manner that at least parts of respective characteristic variation curves of the two or more segment templates overlap with each other, and producing a synthesized envelope for the given performance section by combining the arranged characteristic variation curves; and a step of generating a tone using the produced synthesized envelope.

18. A tone generation method comprising:

a step of supplying performance information;

a step of supplying segment templates each including a characteristic variation curve, the segment templates including note segment templates corresponding to substantial total lengths of tones and tone-portion segment templates corresponding to lengths of tone portions;

a step of, in correspondence with a given performance section of a tone based on the performance information, selecting one note segment template and one or more tone-portion segment templates, arranging the selected note segment templates in the given performance section of the tone and the selected tone-portion segment templates in a part of the given performance section of the tone, and producing a synthesized envelope for the given performance section by combining respective characteristic variation curves of the arranged segment templates; and a step of generating a tone using the produced synthesized envelope.

19. A computer program containing a group of instructions to cause a computer to perform a tone generation method, said tone generation method comprising:

supplying performance information;

supplying a plurality of segment templates of different lengths, each of the segment templates including a characteristic variation curve;

arranging two or more segment templates of different lengths, in correspondence with a given performance section based on the performance information, in such a manner that at least parts of respective characteristic variation curves of the two or more segment templates overlap with each other, and producing a synthesized envelope for the given performance section by combining the arranged characteristic variation curves; and generating a tone using the produced synthesized envelope.

20. A computer program containing a group of instructions to cause a computer to perform a tone generation method, said tone generation method comprising:

supplying performance information;

supplying segment templates each including a characteristic variation curve, the segment templates including note segment templates corresponding to substantial total lengths of tones and tone-portion segment templates corresponding to lengths of tone portions;

in correspondence with a given performance section of a tone based on the performance information, selecting one note segment template and one or more tone-portion segment templates, arranging the selected note segment templates in the given performance section of the tone and the selected tone-portion segment templates in a part of the given performance section of the tone, and producing a synthesized envelope for the given performance section by combining respective characteristic variation curves of the arranged segment templates; and generating a tone using the produced synthesized envelope.

21. A tone generation apparatus comprising:

a performance information supply section that supplies performance information;

a segment template supply section that supplies a segment template representative of a characteristic variation curve;

a modification section that places the segment template on a time axis based on performance timing specified by the performance information and modifies the characteristic variation curve of the placed segment template;

an envelope synthesis section that produces a basic envelope on the basis of the performance information and combines the characteristic variation curve, modified by said modification section, with the basic envelope, to thereby produce a synthesized envelope; and a tone generation section that generates a tone using the synthesized envelope produced by said envelope synthesis section.

22. A tone generation apparatus as claimed in claim 21 wherein the segment template includes a set of characteristic variation curves related to a plurality of kinds of tone factors, and wherein said envelope synthesis section produces respective basic envelopes of the plurality of kinds of tone factors on the basis of the performance information and produces respective synthesized envelopes of the plurality of kinds of tone factors by combining the produced basic envelopes with the characteristic variation curves of the corresponding tone factors.

23. A tone generation apparatus as claimed in claim 22 wherein said modification section is capable of modifying a level or time length of the characteristic variation curve of each of the plurality of kinds of tone factors.

24. A tone generation apparatus as claimed in claim 21 wherein the characteristic variation curve of the segment template is arranged on the time axis on the basis of note-on or note-off timing included in the performance information.

25. A tone generation apparatus as claimed in claim 21 wherein said segment template supply section supplies at least one of a segment template corresponding to an attack portion of a tone and a segment template corresponding to a release portion of the tone, and wherein said modification section controls an attack portion or release portion of an envelope by modifying a level or time length of the characteristic variation curve of the segment template supplied by said segment template supply section.

26. A tone generation apparatus as claimed in claim 21 wherein said modification section modifies an amplitude level or time length of the characteristic variation curve.

27. A tone generation apparatus as claimed in claim 21 wherein the segment template includes position information and is arranged on the time axis in accordance with the position information.

28. A tone generation method comprising:

a step of supplying performance information;

a step of supplying a segment template representative of a characteristic variation curve;

a step of arranging the segment template on a time axis based on performance timing specified by the performance information and modifying the characteristic variation curve of the arranged segment template;

a step of producing a basic envelope on the basis of the performance information, arranges and combines the modified characteristic variation curve with the basic envelope, to thereby produce a synthesized envelope; and a step of generating a tone using the produced synthesized envelope.

29. A computer program containing a group of instructions to cause a computer to perform a tone generation method, said tone generation method comprising:

supplying performance information;

supplying a segment template representative of a characteristic variation curve;

arranging the segment template on a time axis based on performance timing specified by the performance information and modifying the characteristic variation curve of the arranged segment template;

producing a basic envelope on the basis of the performance information, arranges and combines the modified characteristic variation curve with the basic envelope, to thereby produce a synthesized envelope; and generating a tone using the produced synthesized envelope.

* * * * *